US007464829B1

(12) United States Patent
Koefelda et al.

(10) Patent No.: US 7,464,829 B1
(45) Date of Patent: Dec. 16, 2008

(54) DIVIDER ASSEMBLY FOR WASTE CONTAINER

(75) Inventors: Gerald R. Koefelda, Seal Beach, CA (US); Gabriel A. Guerra, Walnut, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/571,425

(22) Filed: May 15, 2000

(51) Int. Cl.
*B65F 1/08* (2006.01)

(52) U.S. Cl. ..... 220/532; 220/909

(58) Field of Classification Search ..... 220/909, 220/529, 532, 533, 908, 507
See application file for complete search history.

(56) References Cited

U.S. PATENT DOCUMENTS

| | | | | | |
|---|---|---|---|---|---|
| 1,711,030 | A | * | 4/1929 | Pifer | 312/140 |
| 1,961,486 | A | * | 6/1934 | Hall | 312/140 |
| 2,161,624 | A | * | 6/1939 | Hoerr | 220/551 |
| 2,885,091 | A | * | 5/1959 | Van Pelt | 211/184 |
| 3,656,786 | A | | 4/1972 | Larson | |
| 3,720,346 | A | | 3/1973 | Cypher | |
| 3,971,360 | A | * | 7/1976 | Spoeth, Jr. | 220/495.05 |
| 4,750,638 | A | | 6/1988 | Sosower | |
| 4,768,661 | A | * | 9/1988 | Pfeifer | 211/184 |
| 4,867,328 | A | | 9/1989 | McCarthy | |
| 5,033,641 | A | | 7/1991 | Martin | |
| 5,035,563 | A | | 7/1991 | Mezey | |
| 5,082,139 | A | | 1/1992 | Quam | |
| D324,595 | S | | 3/1992 | Beese et al. | |
| 5,103,998 | A | * | 4/1992 | Caro et al. | 220/909 |
| 5,150,809 | A | | 9/1992 | Leigh | |
| 5,163,805 | A | | 11/1992 | Mezey | |
| 5,183,180 | A | | 2/1993 | Hawkins et al. | |
| 5,205,698 | A | | 4/1993 | Mezey | |
| 5,303,841 | A | | 4/1994 | Mezey | |
| 5,328,048 | A | | 7/1994 | Stein | |
| 5,474,200 | A | | 12/1995 | Nicholson | |
| 5,615,797 | A | * | 4/1997 | Ripamonti | 220/529 |
| 6,019,242 | A | | 2/2000 | Wysocki et al. | |
| 6,050,442 | A | | 4/2000 | Wysocki | |
| 6,129,233 | A | | 10/2000 | Schiller | |

FOREIGN PATENT DOCUMENTS

| | | | | |
|---|---|---|---|---|
| WO | 94/01349 | * | 1/1994 | 220/909 |

OTHER PUBLICATIONS

Photos of Otto Plastics divider & clip, undated, but believed to be prior art.

* cited by examiner

*Primary Examiner*—Stephen Castellano
(74) *Attorney, Agent, or Firm*—Carlson, Gaskey & Olds

(57) ABSTRACT

A divider assembly is adapted for installation in a waste container which includes a divider member and at least one retention member. The divider member is axially receivable within the waste container and includes an upper surface which defines a plane, and a pair of opposed upper side portions. The retention member is attachable the waste container and cooperates with a corresponding one of the pair of opposed upper side portions of the divider member in order to secure the divider member within the waste container. In operation, the retention member is disposed below the plane of the upper surface of the divider member.

18 Claims, 11 Drawing Sheets

DIVIDER ASSEMBLY FOR WASTE CONTAINER

TECHNICAL FIELD

This invention relates to a divider assembly for a waste container, and also to a waste container incorporating the divider assembly.

BACKGROUND ART

Many municipalities today that offer trash pickup services require that trash, recyclables, or other household or commercial waste be separated prior to pickup. For example, it is often required that a homeowner separate plastic from glass, or yard waste from household waste. Many of these same municipalities may provide property owners with a waste container that is designed such that it may be lifted and emptied by automated machinery associated with a garbage truck, thereby providing uniformity to the municipalities' waste collection services.

In order to keep the trash separated, a divider may be inserted into the waste container. However, due to the force to which the waste container and divider are subjected upon emptying by the automated machinery, it is possible that the divider may become damaged or even separated from the waste container.

U.S. Pat. No. 5,615,797 to Ripamonti discloses an insert for a rubbish bin. This insert requires a sleeve which is positioned adjacent the bottom wall of the rubbish bin having a first engaging means. This patent requires a panel which is inserted into the bin and is engageable with the first engaging means. Also, other means are disclosed to prevent the panel from being removed from the bin upon emptying. However, clips 20*a*, 20*b* in Ripamonti are subject to breakage during emptying when the clips 20*a*,20*b* contact the trash truck. In some instances, the garbage truck may have a wall which upon emptying contacts the clips holding the divider, thereby causing the divider to become separated from the waste container. Because the Ripamonti clip is disposed on the upper surface of the divider, a broken clip will allow the divider to loosen or become separated from the rubbish bin. Also, because the clip is raised above the divider, it receives the greatest amount of force and stress during emptying.

Accordingly, an improved divider assembly for a waste container is desired which is securely mounted, sturdy and robust when subjected to force, such as when the waste container is emptied. The divider assembly should not loosen or become separated from the waste container during emptying or other times. An improved waste container having a divider assembly with the above-noted improvements is also desired.

DISCLOSURE OF INVENTION

It is an object according to the present invention to provide a divider assembly for a waste cart which is robust, sturdy and stable, particularly when the waste container is emptied and subject to force or other stresses.

It is another object according to the present invention to provide a divider assembly for a waste container which is relatively easy to install into the waste container.

It is still another object according to the present invention to provide a divider assembly for a waste container wherein the divider member is subject to relatively more force than the accompanying retention member which attaches the divider to the waste container, particularly while emptying the container.

It is yet another object according to the present invention to provide a divider assembly for a waste container which secures the divider member along the axis in which it is inserted into the waste container.

It is also an object according to the present invention to provide an improved waste container having a divider with the above-noted objects.

In accordance with the teachings of the present invention, provided is a divider assembly adapted for installation in a waste container which includes a divider member and at least one, but preferably two, retention members. The divider member is axially receivable within the waste container and includes an upper surface which defines a plane, and a pair of opposed upper side portions. The retention member is attachable to the waste container and cooperates with a corresponding one of the pair of opposed upper side portions of the divider member in order to secure the divider member within the waste container. In operation, the retention member is disposed below the plane of the upper surface of the divider member. In one embodiment, the retention member has a pair of opposed sidewalls for receiving the divider member therebetween. The divider assembly also includes a center portion disposed between the pair of opposed upper side edges, such that the pair of opposed upper side edges of the divider member are relatively thinner than the center portion for being received within the retention member. Moreover, the at least one-retention member has an inner surface which mates with and corresponds to a corresponding upper side edge of the divider member. Also, in one embodiment, the upper side edges of the divider member are contoured for mating with a corresponding mating surface of the at least one retention member. Further, the retention member is disposed within the waste container along an axis parallel to the axis in which the divider member is received within the waste container. In addition, the upper side portions of the divider member include a pair of opposed upper side edges, and the at least one retention member includes a main body portion which is disposed within the waste container and engages a corresponding upper side edge.

Also disclosed in accordance with the present invention is a divider assembly which is adapted to divide an inner compartment of a waste container that has a top, a bottom, and a pair of opposed container walls. The divider assembly includes a divider member which is insertable into the compartment of the waste container and which longitudinally extends from the top to the bottom of the waste container to define a plurality of sub-compartments. The divider member also includes a pair of opposed lateral side edges which are each disposed adjacent a corresponding one of the opposed container walls. The divider assembly also includes a pair of retaining members, each of which is attachable to one of the opposed container walls, and includes a main body portion disposed within the compartment of the container to define a longitudinally directed channel for slidably receiving therein a corresponding one of the opposed lateral side edges of the divider member as it is inserted into the compartment of the waste container.

The divider assembly has a central portion which is disposed between the pair of opposed lateral side edges, and also the pair of opposed lateral side edges have a relatively smaller thickness than the central portion for being received within the channel of the retention member. Further, each of the retaining members has an inner surface which mates with and corresponds to a corresponding opposed lateral side edge of the divider member. Moreover, the pair of opposed lateral side edges of the divider member are contoured for mating with a corresponding mating surface of a retaining members.

In addition, each of the retaining members cooperates with the divider member along an axis parallel to the axis in which the divider member is received within the waste container. Further, each retaining member is operably mounted within the waste container below a plane defined by a top surface of the divider member.

In still keeping with the teachings according to the present invention, also provided is a waste container assembly having a divider assembly installed therein. The waste container assembly includes a waste container, a divider member, and a pair of retention members. The waste container has a bottom portion and an upstanding wall portion attached to the bottom portion which together define an inner compartment within the waste container. The upstanding wall portion has an an inner surface and a rim portion. The divider member is received within the inner compartment of the waste container and has a pair of laterally opposed side edges each having an upper side edge portion and an intermediate side edge portion. The upper side edge portion has an outer surface, and the intermediate side edge portion has an upper surface which defines a notch between the upper side edge portion and the intermediate side edge portion. The retention members have an end portion attached to the rim portion of the waste container and a body portion and longitudinally oriented and disposed on a corresponding upper side edge of the divider member for attaching the divider member to the waste container. Each retention member defines a channel which is disposed therethrough for slidably receiving the corresponding upper side edge of the divider member therein. Each retention member further includes a rear wall which has a corresponding surface for mating with the outer surface of the upper side edge portions of the divider member. The retention member also has a lower wall which is received by the notch and which is disposed above the upper surface of the intermediate side edge portion for impeding the axial movement of the divider member upon emptying the waste container. In the disclosed embodiment, the upstanding wall portion of the waste container also includes a plurality of lower receiving members integrally formed therein and projecting into the inner compartment of the waste container, while the divider member includes a lower side edge portion disposed below the intermediate side edge portion and which is received by the lower receiving members of the waste container for preventing lateral movement of the lower side edges. The pair of opposed lateral side edges of the divider member may be contoured for mating with a corresponding mating surface of the retention members.

In keeping with the teachings according to the present invention, also provided herein is a method of installing a divider assembly into a waste container which method includes providing a waste container that has an outer edge with opposed openings formed therein, and also has a bottom wall and a sidewall member to define an inner compartment. The method further includes providing a pair of retention members, each of which have an end portion, a pair of opposed side walls, a divider mating surface, a rear wall, and a lower wall. The method further calls for inserting the end portion of each retention member into a corresponding one of the opposed openings formed on the outer edge of the waste container, such that the end portion is oriented perpendicular to the upper edge of the waste container. The method also includes rotating each retention member approximately 90° so that the end/foot portion is disposed under and parallel to the upper edge of the waste container, and the rear wall of each retention member is facing the side wall of the waste container. Also included is providing a divider member having a pair of laterally opposed side edges each of which has an upper side edge and an intermediate side edge. The upper side edges have an outer surface, and the intermediate side edges have an upper surface that defines a notch between the upper side edges and the intermediate side edges.

Also included in the method is inserting the divider member axially into the inner compartment of the waste container such that the outer surface of the upper side edges of the divider member each mates with a corresponding divider mating surface of the retention member, and the lower wall of the retention member is disposed in the notch in the divider member. This method also may include providing the waste container such that the sidewall member has a lower wall portion with a plurality of receiving members formed therein, also may include providing the divider member such that the laterally opposed side edges have a lower edge portion, may further include inserting the divider such that the lower edge portions of the divider member are received by the receiving members of the waste container in order to impede lateral movement of the divider member therein.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
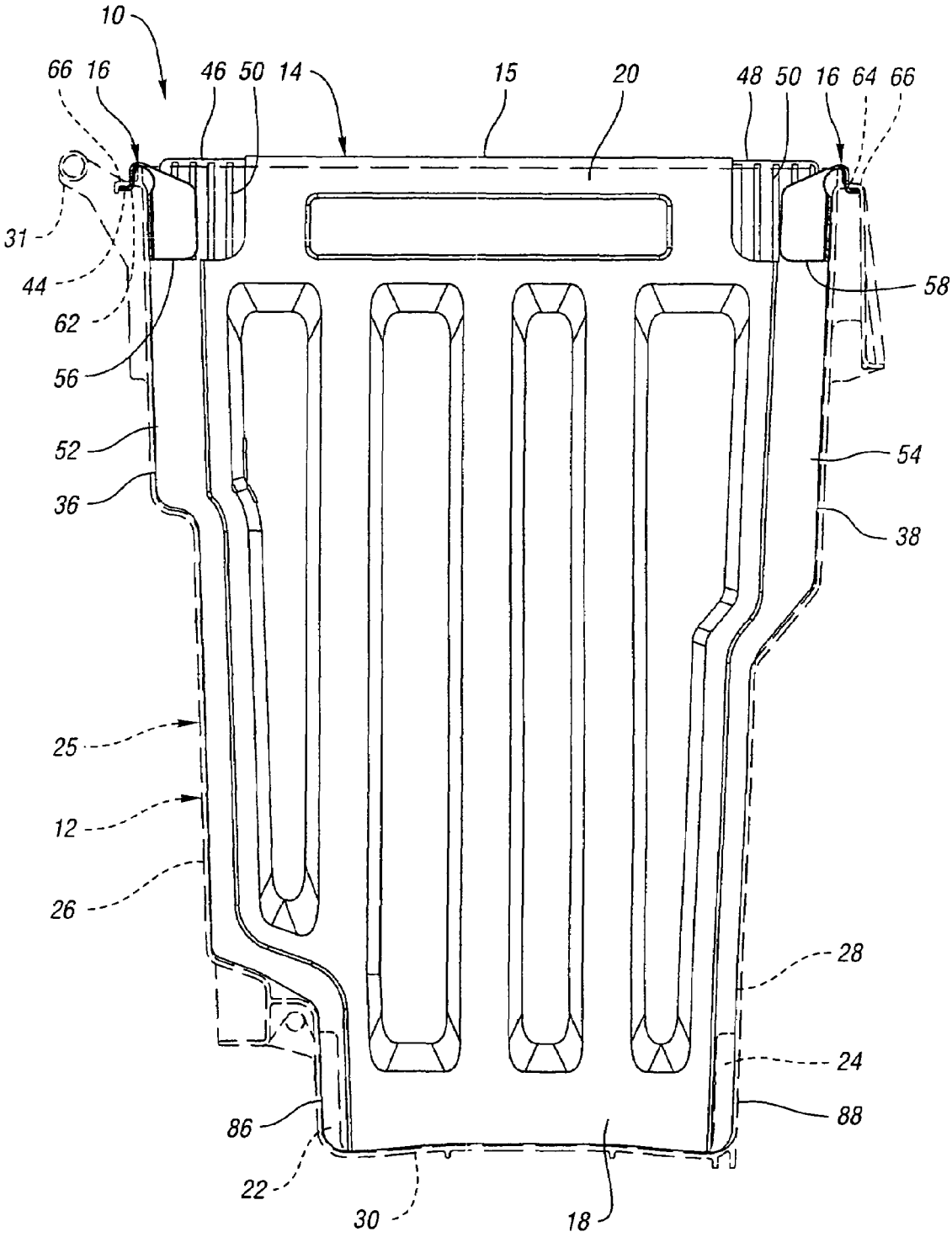
FIG. 1 illustrates a side elevational view of the divider assembly according to the present invention which is shown as fully installed within a waste container (shown in broken lines), and particularly illustrates the assembled divider panel member and clip members.

In accordance with the present invention, a divider assembly 10 is disclosed herein. Divider assembly 10 is adapted for installation and use with a waste container 12, which for ease of reference is illustrated in broken lines in FIG. 1 (and is shown in solid lines in FIGS. 2*b* and 3*b*.) Waste container 12 is known in the art by various names, including trash cart, trash bin, and refuse container. Divider assembly 10 includes a divider member 14 and at least one, but preferably two retention members 16 (also referred to as retaining members or clip members) attached thereto for mounting divider member 14 to waste container 12. Divider member 14 and retention members 16, like waste container 12, are formed of a durable plastic material and are preferably formed in an injection molding process. Clip member 16 is more fully illustrated and described in FIGS. 5-11 and the associated text, while divider member 14 is more fully illustrated in FIGS. 12-17 and associated text.

Referring again to FIG. 1, waste container 12 includes an integrally formed upstanding sidewall member 25 extending upwardly from a container bottom wall 30. Upstanding sidewall member 25 and bottom wall 30 define an inner compartment to container 12. Particularly upstanding sidewall member 25 has opposed sidewall portions 26,28, respectively adjacent its bottom wall 30. Opposed sidewall portions 26,28 are specifically referred to as front and rear sidewalls herein, for ease of discussion and reference only. Container 12 may also include a rear handle portion 31 to allow a user to grasp and move the container 12. FIG. 2*a* illustrates a right side elevational view of the upper portion of divider assembly 10 according to the present invention installed within waste container 12. FIG. 2*b* illustrates a left side elevational view of the upper portion of the divider assembly 10 according to the present invention, installed within waste container 12 (shown in broken lines.) FIG. 3*a* is a left side elevational exploded assembly view and illustrates the assembly of divider assembly 10 into waste container 12 according to the present invention. FIG. 3*b* is a right side elevational exploded assembly view of divider assembly 10.

Divider member 14 extends axially and longitudinally into waste container 12 from upper edge surface 27 to bottom 30. It is fully contemplated that the width of divider 14 member may extend within the compartment of container 12 from front to back (as illustrated herein), from left side to right side, or other opposed sides, without departing from the teachings according to the present invention. Also, depending on the desired use and application, divider assembly 10 may be used to separate waste container 12 inner compartment into equally sized sub-compartments, or they may be unequal. As illustrated in FIGS. 1-3 and 12-17, edges 36,38 of divider member 14 have various shapes and contours which correspond to the internal shape of the container into which divider member 14 is inserted.

Figure 2A:
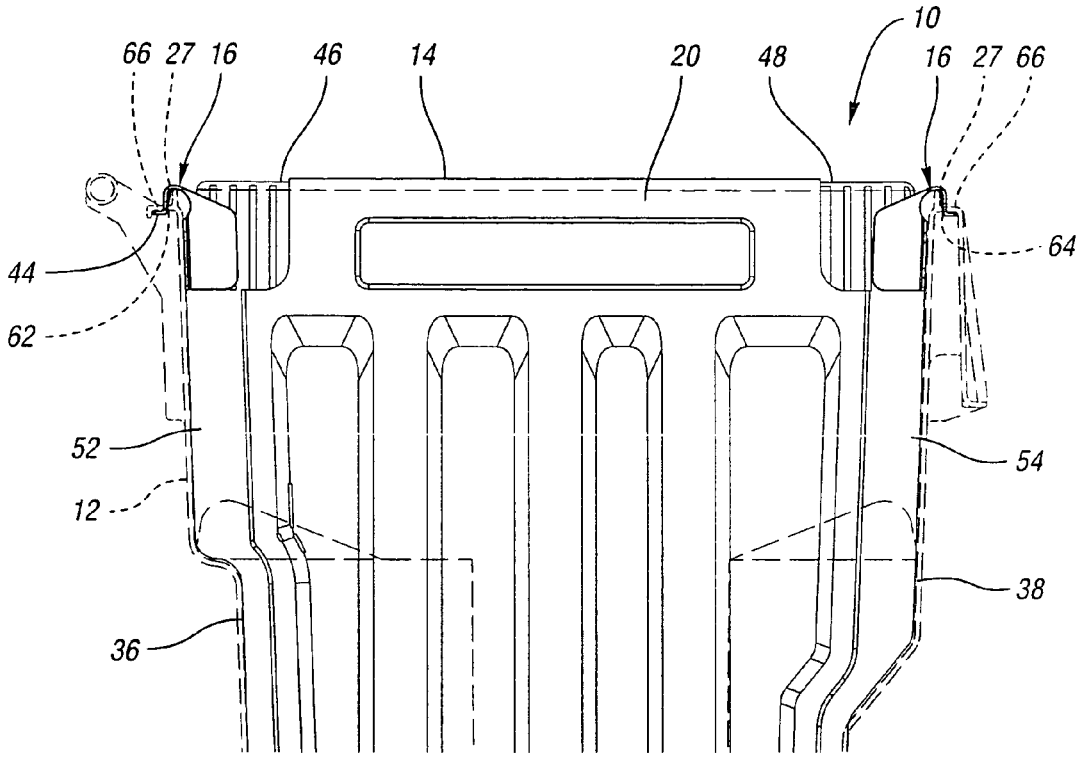
FIG. 2*a* illustrates an enlarged view of the upper portion of the divider panel assembly of FIG. 1.
Figure 2B:
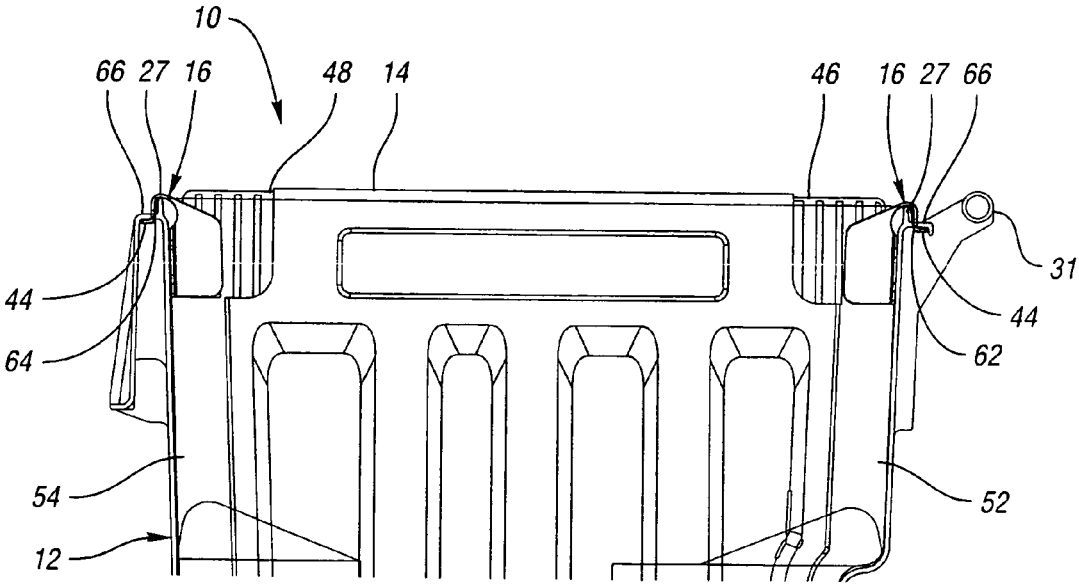
FIG. 2*b* illustrates a mirror image of the divider panel assembly shown in FIG. 2*a*, but with the waste container shown in solid lines.
Figure 3A:
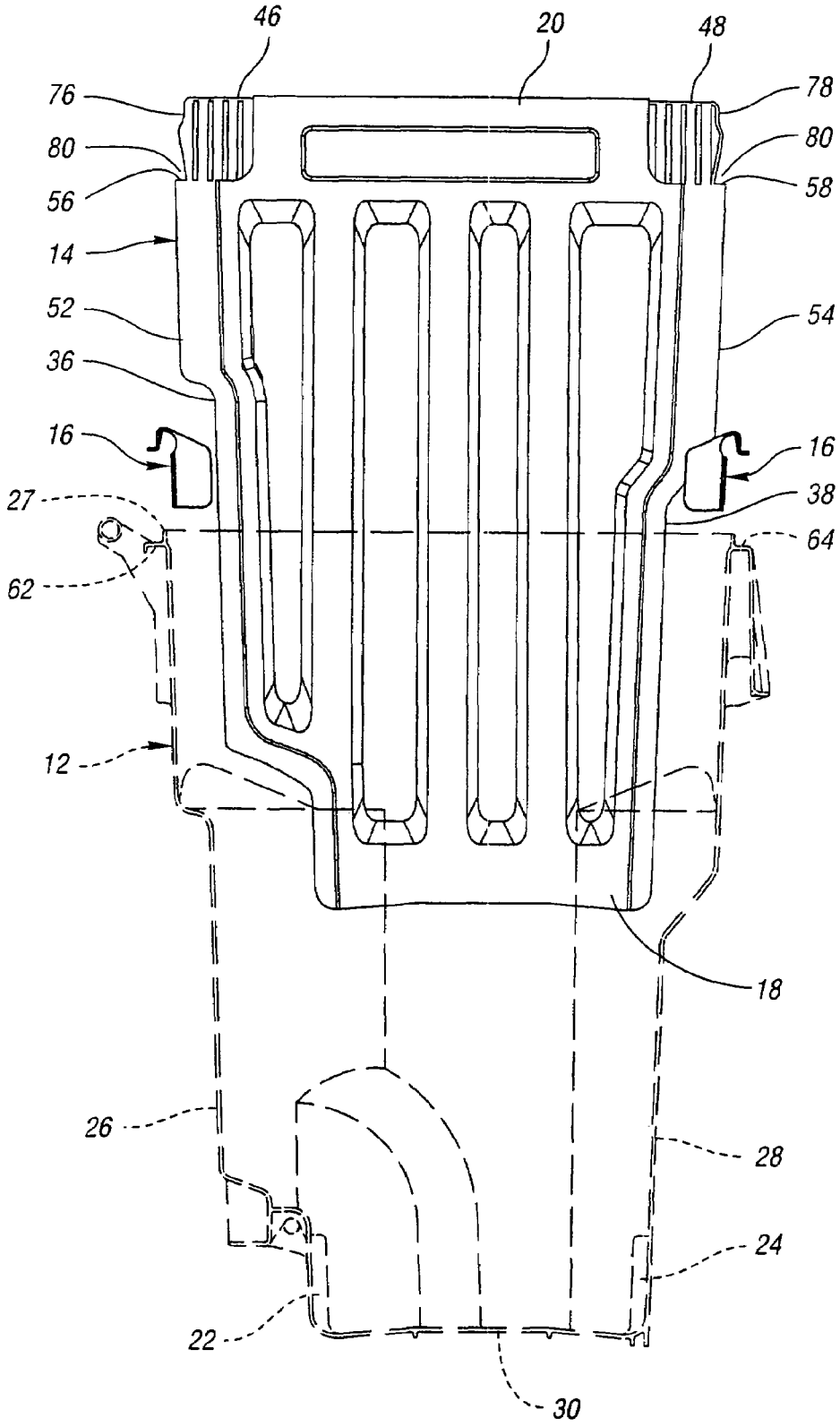
FIG. 3*a* is a left side exploded assembly view of the divider assembly according to the present invention.
Figure 3B:
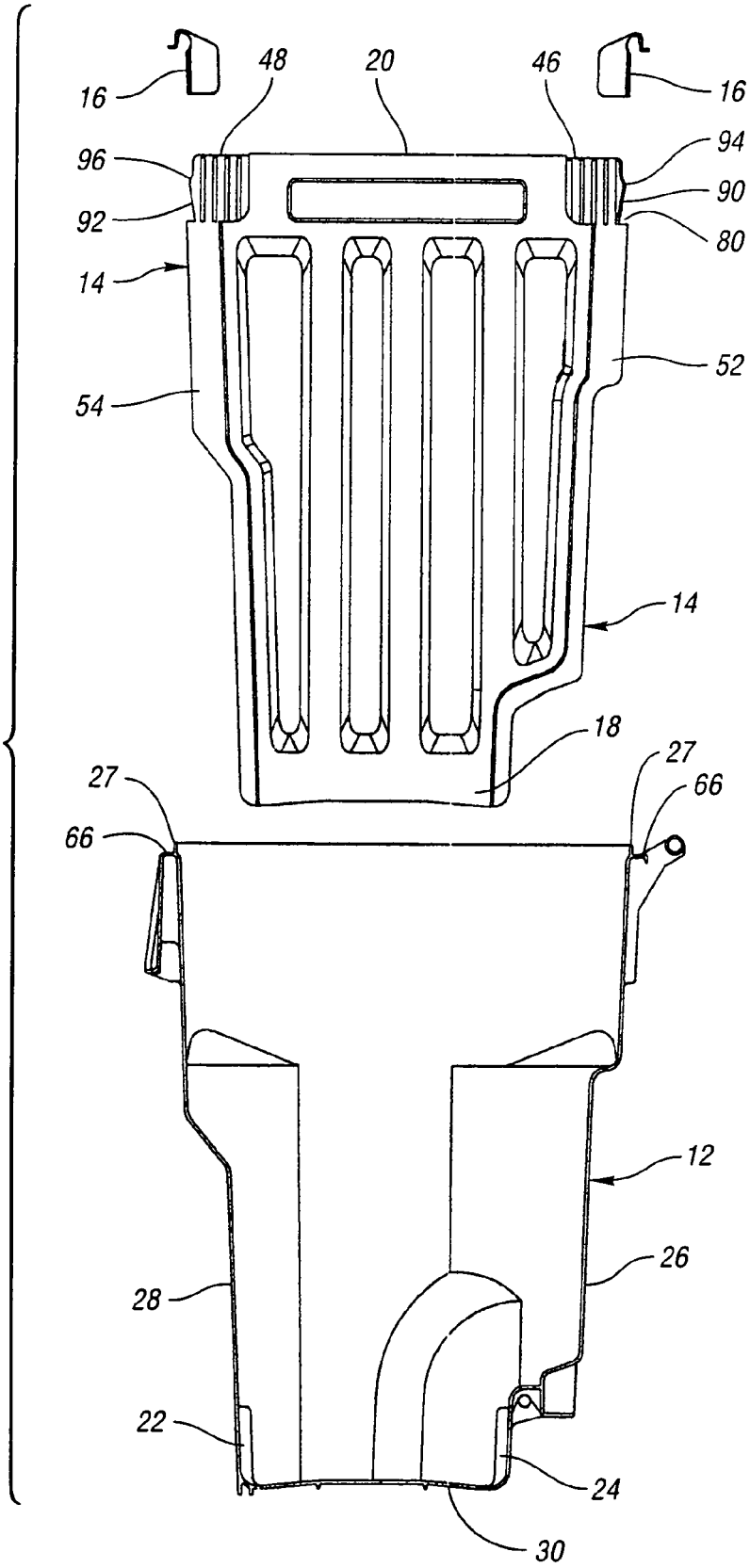
FIG. 3*b* is an alternate exploded assembly view of the right side of the divider assembly, wherein the waste container in a cross-sectional view.
Figure 18:
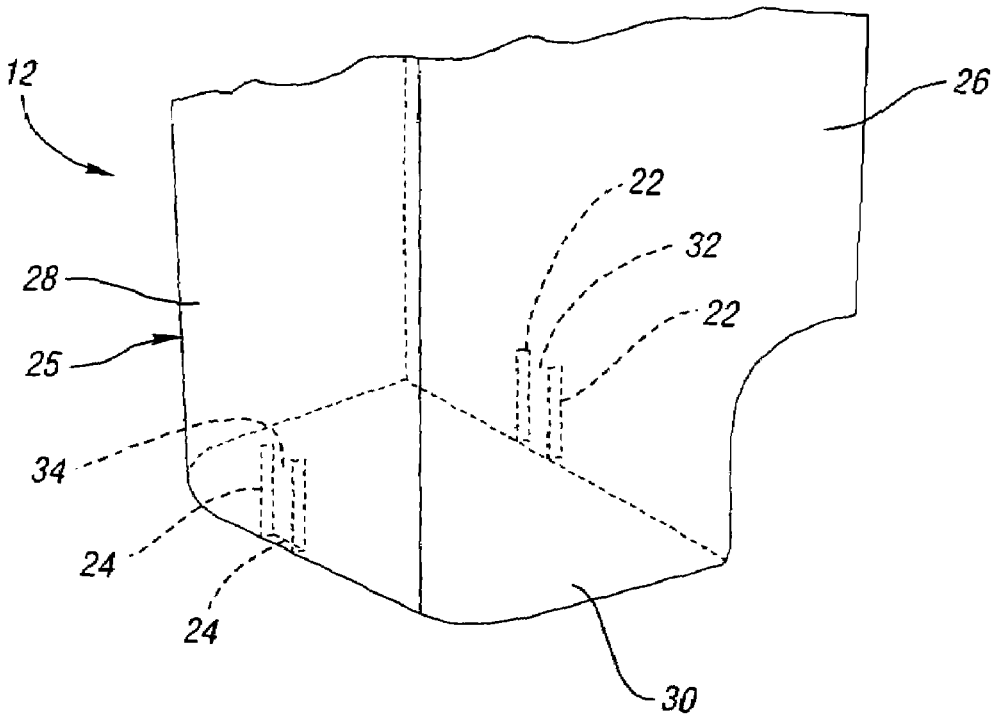
FIG. 18 is a partial perspective view of the bottom of the waste container according to the present invention.

As illustrated in FIGS. 1, 2*a*, 2*b*, and 3*a*, divider assembly 10 is installed within and received by waste container 12. In the embodiment illustrated, divider member 14 is secured to container 12 at both its lower end portion 18 and upper end portion 20, to retain divider member 14 laterally, transversely, and rotationally. In the embodiment illustrated in FIG. 1, opposed sidewalls 26, 28 includes a plurality of rear and front rib members 22,24, respectively integrally formed to the sidewalls 26,28. Rear rib members 22 project inwardly from rear wall 26 toward the center of waste container 12, while front rib members 24 project inwardly from front wall 28 toward the center of waste container 12. FIGS. 1 and 18 show a plurality of rib members 22,24, including two front ribs 22 vertically oriented, centrally disposed, and spaced apart on the rear wall 26 of waste container 12, and two front rib members 24 vertically oriented, centrally disposed, and spaced apart on the front wall 28 of waste container 12. The pair of rear rib members 22 are spaced apart to define a rear divider receiving channel 32 therebetween, while front rib members 24 are spaced apart to define a front divider receiving channel 34 therebetween. Thus, when divider member 14 is inserted into waste container 12, the bottom portion 18 of divider member 14 is received within vertically oriented divider receiving channels 32,34, thereby securing lower portion 18 of divider member 14 within waste container 12. Of course, inserting divider member 14 also serves to divide waste container 12 into two sub-compartments, one on each side of divider member 14. As discussed herein and further shown in FIG. 1, the upper portion 20 of divider member 14 is held in position in waste container 12 by the pair of clip members 16.

As more fully illustrated in FIGS. 1, 2*a*, 2*b*, 3*a*, 3*b*, 4*a*, 4*b*, and 4*c*, in use, clip members 16 are vertically oriented within waste container 12 along the front edge 38 and rear edge 36 of divider member 14, respectively. As best shown in FIGS. 5-11, each clip member includes a main body portion 40 and a leg portion 42. Leg portion 42 includes an end portion 44. As discussed herein, end portion may have many shapes and functional forms, including the foot portion 49 illustrated in FIGS. 5-11 and the expanding snap portion 49' illustrated in FIG. 19.

As further noted in FIG. 1, each of the rear and front edges 36,38 of divider member 14 has a corresponding upper side portions 46,48, respectively, which are shown in the drawings as areas having projections such as ribs 50 projecting therefrom for stiffness. Oriented below divider upper side portions 46,48 along opposed side edges 36,38 is a rear intermediate side portion 52 and a front intermediate side portion 54. Each intermediate divider side portions 52,54 has an upper edge 56,58, respectively. Once in the use position in container 12, a lower wall 60 of clip main body portion 40 acts as a locking member and is disposed adjacent upper edge 56, 58 of intermediate divider side portions 52,54, as shown in FIG. 4*b*. In light of molding and build variations, clip lower wall 60 may engage intermediate upper edges 56,58, or may also be slightly spaced apart therefrom, without deviating from the teachings according to the present invention.

Waste container 12 also has an outer rim portion 66 which is a generally horizontally flanged member which is oriented and extends fully or partially around the exterior surface of waste container 12. Outer rim portion 66 has at least two openings 62,64 extending therein, corresponding to the desired located of the clips 16, and in the embodiment shown are at the front and rear of container 12. As further illustrated in FIGS. 1, 2*a* and 2*b*, end portion 44 of clip 16 is received within vertically oriented openings 62,64, formed in outer rim portion 66 of container 12. Upper edge 27 of sidewall member 25 defines the upper opening to the compartment of container 12 and also defines a plane. Outer rim portion 66 is illustrated as perpendicular to sidewall 25 and proximate and adjacent upper edge 27 of waste container 12.

As shown in FIGS. 2*a*-2*b*, In the use position, end portion 44 is generally parallel with outer rim portion 66 of waste container 12. Thus, when container 12 is inverted for emptying, end portion 44 of clip member 16 interferes with and is retained by upper container outer rim portion 66, thereby preventing clip 16 from becoming disengaged from waste container 12. Accordingly, in keeping with the present invention, end portion 44 may be represented by any sized or shaped portion or flanged member which at least partially extends under and is retained by upper container rim portion 66. Additionally, as mentioned above, during emptying, intermediate side portions 52,54 of divider member 14 interfere with and are retained by lower wall 60 of clip 16. These features in turn prevents divider member 14 from becoming separated from waste container 12.

Figure 6:
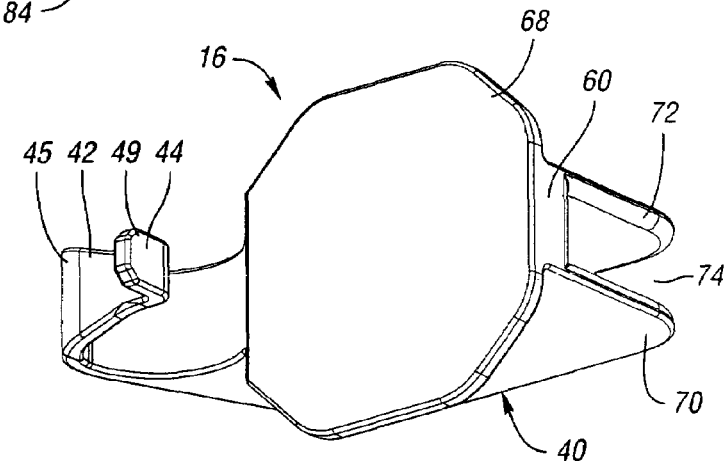
FIG. 6 is a rear perspective view of the clip member according to the present invention.
Figure 7:
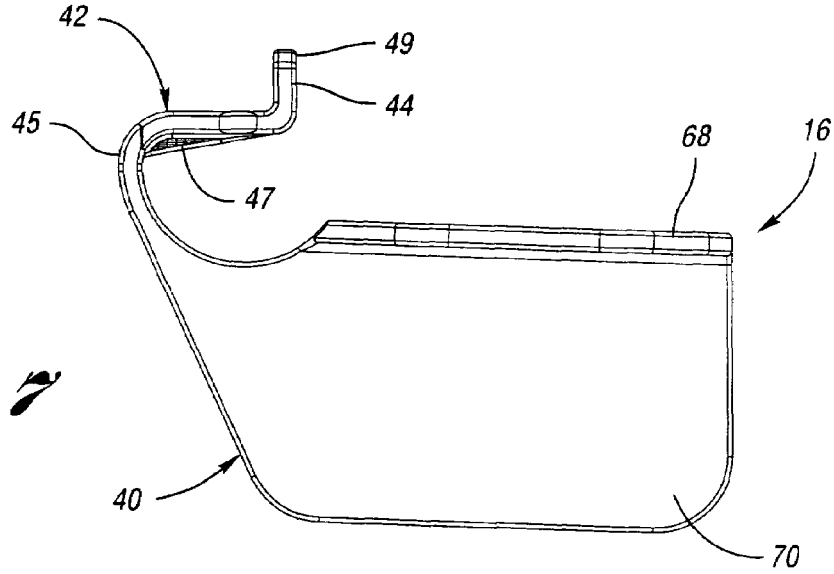
FIG. 7 is a top plan view of the clip member of FIG. 5, the bottom plan view being a mirror image thereof.
Figure 8:
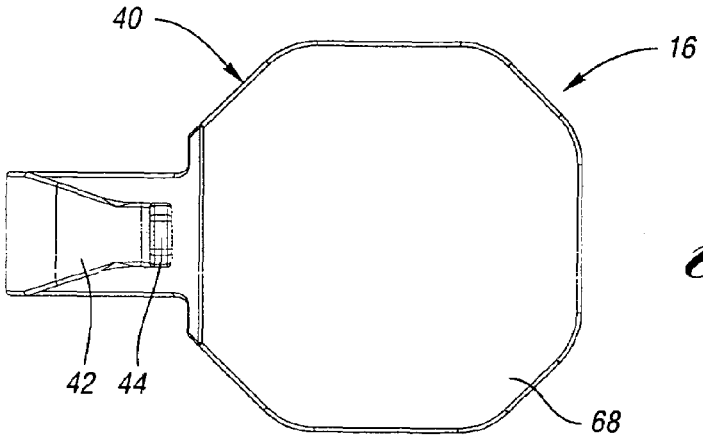
FIG. 8 is a rear elevational view of the clip member of FIG. 5.
Figure 9:
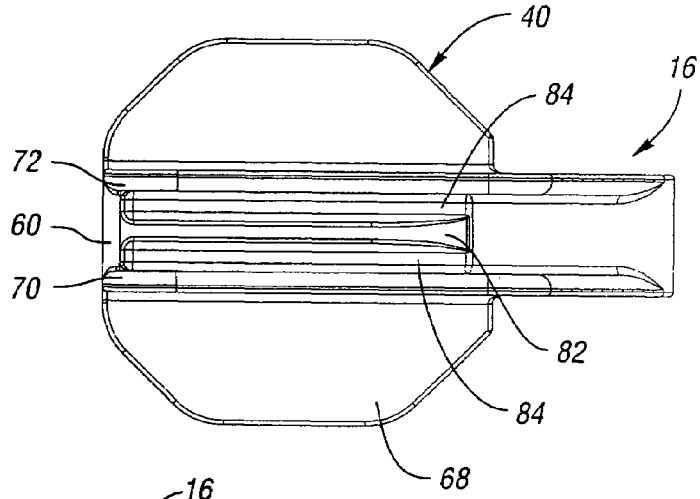
FIG. 9 is a front elevational view of the clip member of FIG. 5.
Figure 10:
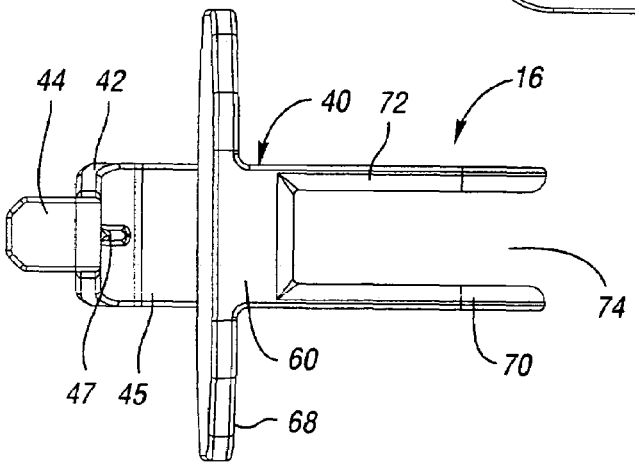
FIG. 10 is a right side elevational view of the clip member of FIG. 5.
Figure 11:
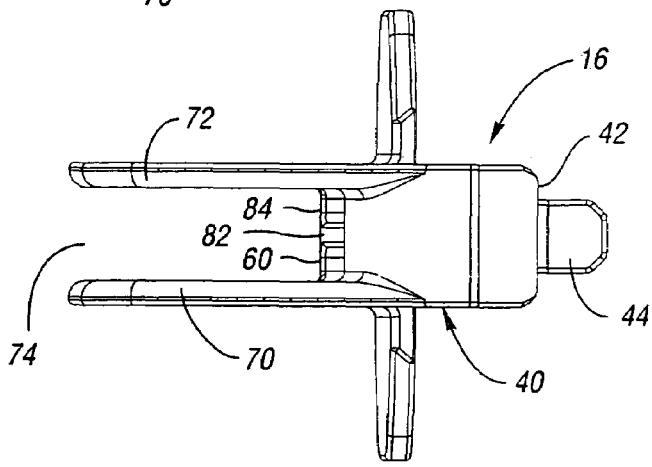
FIG. 11 is a left elevational view of the clip member of FIG. 5.

As fully illustrated in FIGS. 5-11, main body portion 40 of clip member 16 includes a rear wall 68, and two opposed, spaced apart sidewalls 70,72 oriented generally perpendicular to rear wall 68. Clip-sidewalls 70,72, lower wall 60, and rear wall 68 together define a divider receiving channel 74 for slidably and axially receiving therethrough side edges 36,38 of divider member 14 according to the present invention. Rear wall 68 is shown in FIGS. 5-11 as having a relatively large surface area. With further reference to FIGS. 5-11, FIG. 5 is a front perspective view of clip member 16, while FIG. 6 is a rear perspective view of clip member 16. In addition, FIG. 7 is a top plan view of clip member 16, wherein the bottom plan view is a mirror image thereof. FIG. 8 is a rear elevational view of clip member 16, while FIG. 9 is a front elevational view of clip member 16. Further, FIG. 10 is a right side elevational view of clip member 16, while FIG. 11 is a left side elevational view thereof. Clip 16 also includes a curved portion 45 between main body portion 40 and leg portion 42, which, as best shown in FIGS. 2*a*-2*b*, rests upon container upper edge 27, and provides a transition between main body portion 40 disposed within container 12, and leg and end portions 42,44 which are disposed on the outside of container 12. Leg portion 42 includes a rib 47 extending generally from end portion 44 to curved portion 45 for providing additional strength and rigidity to that area of clip retention member 16.

To install divider assembly 10 within container 12, discussion is representatively directed to one side of divider member 14, but applies equally to both sides. In accordance with the method and assembly according to the present invention, end portion 44 of clip 16 is represented by a foot portion 49 as shown in FIGS. 5-11. To install and mount clip member 16 to waste container 12, clip member 16 is oriented such that foot portion 49 is directed downward and inserted through rear opening 62 in outer rim portion 66 such that foot portion 49 is generally perpendicular to outer rim portion 66, rear wall portion 68 is oriented downward and in a plane generally parallel to outer rim portion 66, and curved portion 45 is directed outboard. Once foot portion 49 is inserted through opening 62, clip 16 is rotated 90° such that foot portion 49 is then oriented generally parallel to outer rim portion 66 and is retained thereunder, while clip rear wall portion 68 is oriented generally perpendicular to outer rim portion 66 and generally parallel to adjacent container wall portion 26 such that it directly faces or engages the adjacent container wall 26 as shown in FIGS. 1, 2*a*, and 2*b*.

Subsequently, divider member 14 is inserted axially into waste container 12, ad depicted in FIGS. 3*a*-3*b*. As divider member 14 is lowered into container 12 in a direction parallel to its longitudinal axis (FIG. 3*a*), side edges 36,38 of divider member 14 are lowered into waste container 12 through clip channel 74, which as previously noted is defined by clip sidewalls 70,72 which are spaced apart and generally parallel to each other. Accordingly, as illustrated in the partial cross-sectional views of FIGS. 4*a*-4*b* in which clip member 16 is shown in cross-section, divider member 14 is axially lowered through clip channel 74 of clip member 16 (best shown in FIGS. 5-11) which are mounted to the front and rear portions of container 12 as heretofore described. Specifically, intermediate side portions 52,54 are inserted through channels 74 in each clip member 16. It is noted that divider member 14 is widest across its intermediate side portions 52,54, such that as divider member 14 is axially inserted into container 12, divider member 14 temporarily deforms the front and rear walls 26,28 of container 12.

Clip member 16 is designed to correspond to and mate with upper side portions 46,48 of divider member 14 during use, which are offset inwardly from intermediate edge portions 56,58. Specifically, in the embodiment illustrated, clip member lower wall 60 defines a locking tab which in its use position mates with and is received by a notched area 80 of divider member 14, between intermediate divider side portions 52,54 and upper side portions 46,48, thereof. However, as relatively wide intermediate divider side portions 52,54 are slidably moving through channel 74, they are in an interference fit with lower wall 60, thereby pushing the front and rear walls 26,28 of container 12 outward at a distance approximately equal to the length of lower wall 60.

Thereafter, as divider member 14 is lowered yet even further into container 12, the relatively wide intermediate divider side portions 52,54 push past clip 16 so that clip 16 engages the upper side portions 46,48 of divider member 14, which have a relatively smaller width across (rear to front) than intermediate divider side portions 52,54. More particularly, as divider member 14 continues to be inserted downward into container 12, each divider upper side edge 76,78 engages and mates with the interior surface of clip 16, as shown in the cross-sectional view of FIGS. 4*a* and 4*b*. Accordingly, when clips 16 engage upper side portions 46,48, the interference between lower wall 60 and intermediate divider side portions 52,54 is overcome, thereby causing the sides of the container 12 to retract back to their original positions, and thereby directing lower wall 60 into notched area 80. Divider member 14 is thereby laterally, transversely, rotatably, and axially secured within clip member 16 and waste container 12. As divider member 14 is being properly inserted into clip member 15, the bottom portion 18 of divider member 14 is inserted into and received by the divider receiving channels 32,34 which are oriented vertically in the bottom portion of container sidewalls 26,28. Divider receiving channels 32,34 receive the lower side edges 86,88 of divider member 14, and thus prevent lateral or rotational movement of divider member 14.

It is noted in FIGS. 1 and 4*a*-4*b* that clip member 16, when in use, is disposed below the plane defined by upper surface 15 of divider member 14. It is illustrated that divider member 14 may extend beyond the opening of waste container 12. Accordingly, as a result of its position, during emptying of waste container 12, clip retention member 16 is not subject to contacting any portion of the garbage truck or associated automated machinery. Thus, the integrity of clip member 16 and the secure attachment of the divider member 14 to waste container 12 is maintained. Also, clip member 16 is oriented to and secures divider member 14 to container 12 in the longitudinal direction, which is the axis along which the prior art is likely to fail, and also the direction upon which divider member 14 is released from container 12 in the absence of clip 16.

Figure 4A:
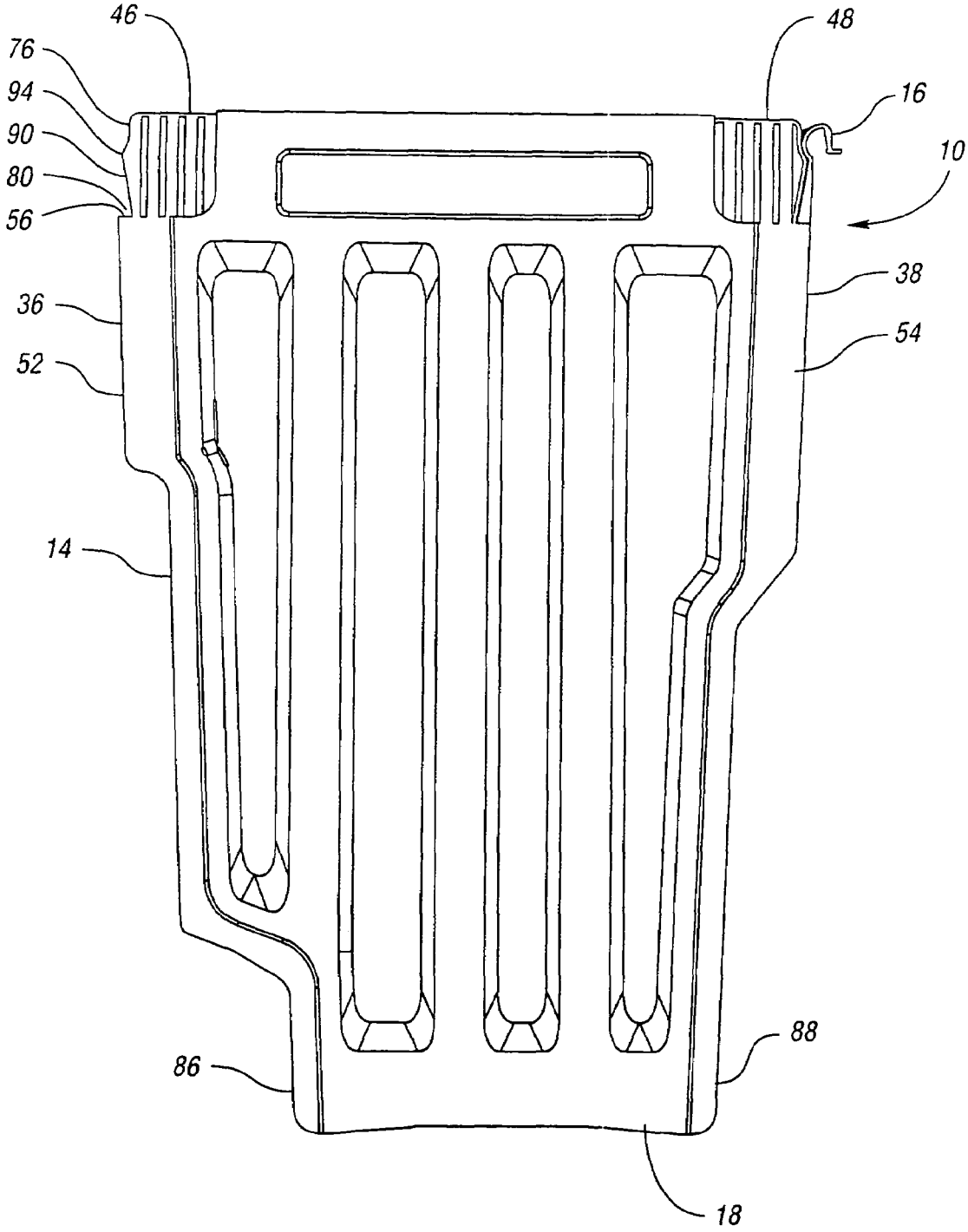
FIG. 4*a* is a partial cross-sectional side elevational view of the divider assembly according to the present invention, and particularly shows the clip member in cross-section.
Figure 4B:
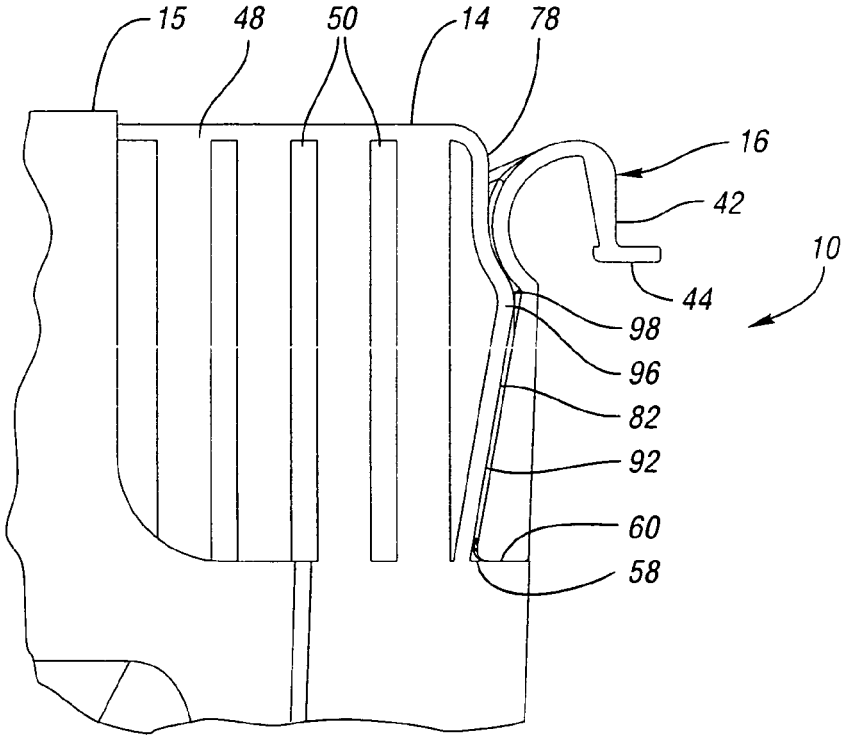
FIG. 4*b* is an enlarged partial cross-sectional view of the divider assembly according to the present invention showing the mating contoured surfaces of the divider panel member and the cross-section of the clip member when in use.
Figure 4C:
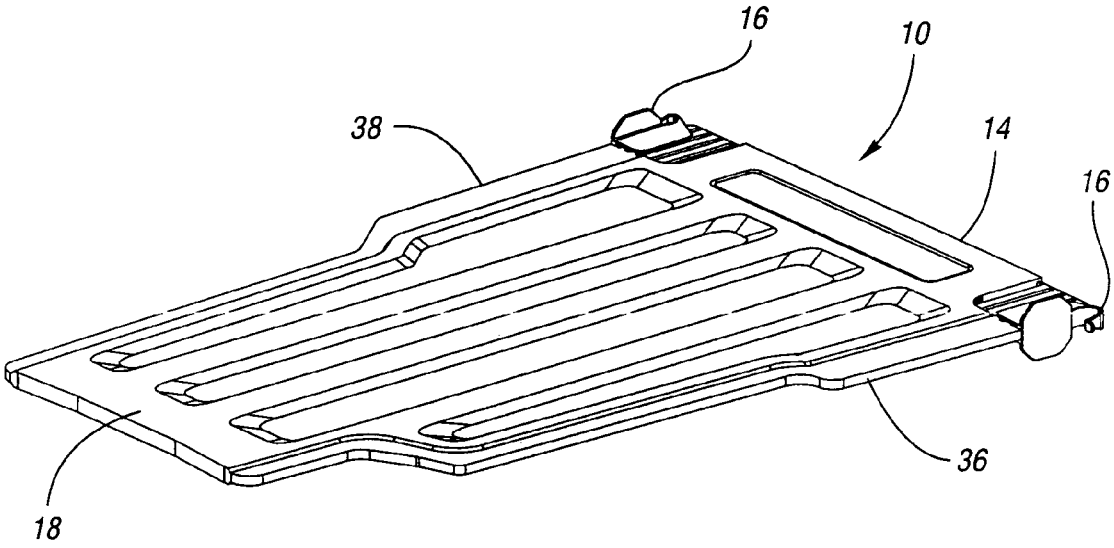
FIG. 4*c* is a perspective view of the divider panel member assembly according to the present invention.
Figure 5:
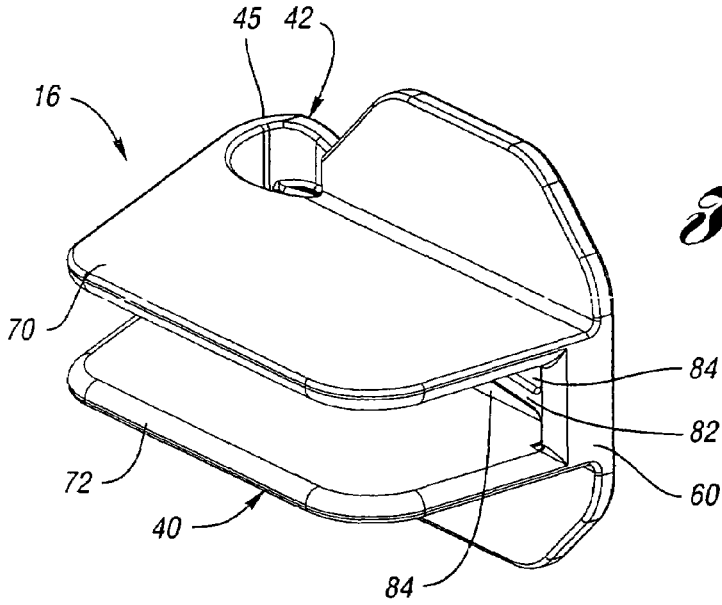
FIG. 5 is a front perspective view of the clip member according to the present invention.

FIGS. 4*a* and 4*b* illustrate a cross-sectional view of divider assembly 10. As shown, the front upper edge 76 and rear upper edge 78 of panel member 14 each have a contoured surface which corresponds to the inner cavity of clip 16. Particularly, each upper edge 76,78 corresponds to and mates with the interior rib member 82 of clip 16, as more fully shown in FIGS. 4*a*, 4*b*, 5, 9, and 11. As illustrated in FIG. 4*b*, interior rib member 82 and upper edge portions 90,92 of divider member 14 are inclined at corresponding angles, while slight edge protrusion 94,96 are received within a similar sized recess 98 in clip 16. Also, note that the interior areas 84 of clip 16 on either side of rib 82 as hollowed out to provide a more flexible, lighter weight, and less expensive clip 16.

With reference to FIGS. 5-11, rear wall 68 of clip 16 defines the widest portion of clip 16. In use, rear wall 68 contacts the inner surface of waste container 12 and provides a relatively large surface area through which clip 16 contacts the inner surface of waste container 12. This wide area of contact between clip 16 and waste container 12 provides lateral and rotational stability to clip 16 and divider member 14. As previously described, rear wall 68 has an octagonal shape, but of course may be of any size or shape applicable to the desired use.

Figure 12:
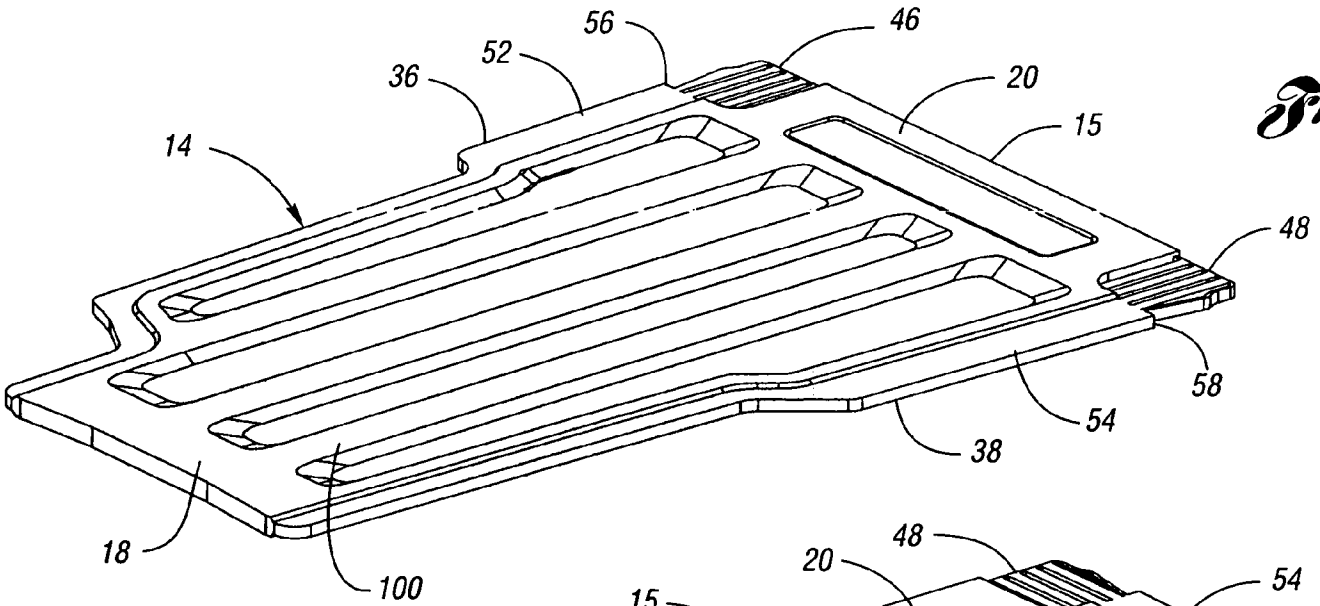
FIG. 12 is a first perspective view of the divider panel member according to the present invention.
Figure 13:
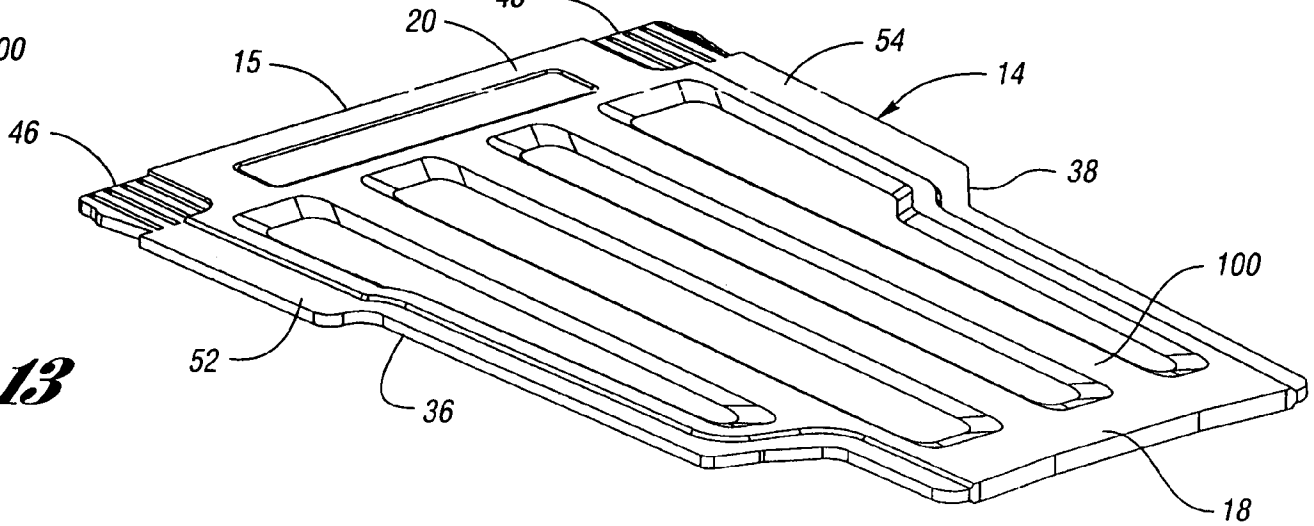
FIG. 13 is a second perspective view of the divider panel member of FIG. 12.
Figure 14:
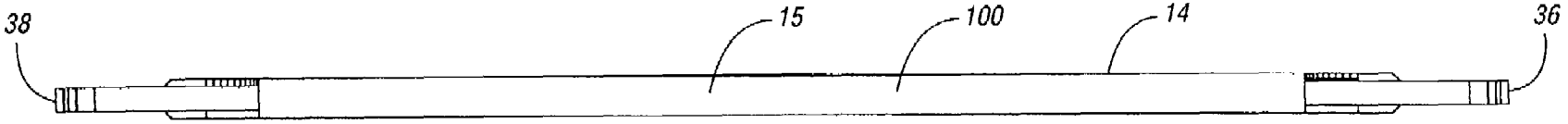
FIG. 14 is a rear elevational view of the divider panel member of FIG. 12.
Figure 15:
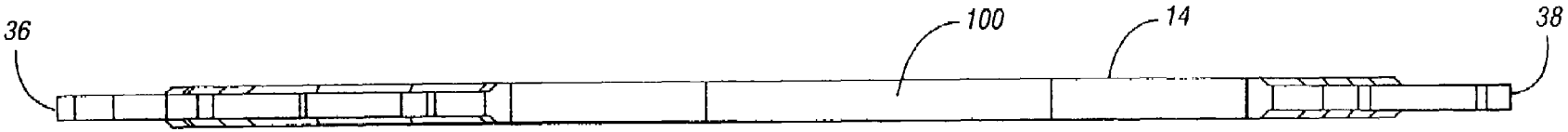
FIG. 15 is a front elevational view of the divider panel member of FIG. 12.
Figure 16:
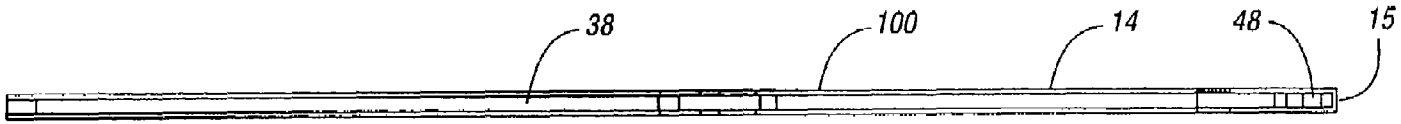
FIG. 16 is a right side elevational view of the divider panel member of FIG. 12.
Figure 17:
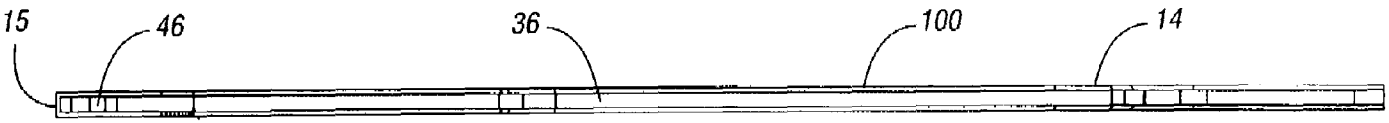
FIG. 17 is a left side elevational view of the divider panel member of FIG. 12.

With reference to FIGS. 12-17, illustrated therein are various views of the divider member 14 according to the present invention. FIG. 12 shows a first perspective view of divider member 14, while FIG. 13 shows a second perspective view of divider member 14. FIGS. 14-17 illustrate various elevational views of divider member 14. For example, FIG. 14 is a rear elevational view of the divider member 14; FIG. 15 is a front elevational view of member 14; FIG. 16 is a right side elevational view of member 14; and FIG. 17 is a left hand elevational view thereof. It is noted in FIGS. 12, 13, 14, and 15 that edges 36,38 having a relatively smaller thickness than central divider portion 100. While divider member 14 is shown as relatively long along its longitudinal axis, it is fully contemplated that, depending on the desired use and application, the teachings according to the present invention are applicable to divider members 14 and corresponding containers 12 having a variety of shapes and sizes.

Figure 19:
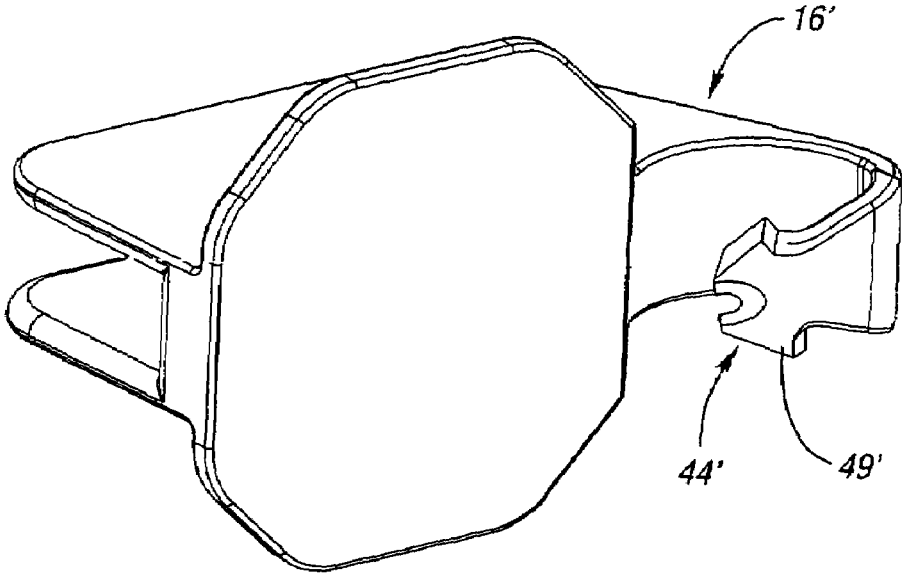
FIG. 19 illustrates a perspective view of a second embodiment of a clip member according to the present invention, having an end portion in the form of an expanding snap portion.

Of course, in keeping with the teachings according with the present invention and with reference to FIG. 19, it is fully contemplated that clip member 16' having end portion 44' in the form of an expanding snap portion or its equivalent may also be used according to the present invention. Whereby the snap portion would be directly inserted into openings 62,64 in container 12, and clip member 16' would be in its operable orientation without the need to rotate the clip member 16.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A waste container assembly comprising:

a waste container having a bottom wall and an integrally-molded upstanding wall attached to the bottom wall and having an inner surface defining an inner compartment, the upstanding wall having an upper edge;

a divider received within the inner compartment of the waste container; and a pair of clips each including a pair of spaced apart side walls extending from a rear wall, the divider disposed between the rear walls of the pair of clips, the spaced apart side walls of each clip having a reduced thickness portion of the divider disposed therebetween, the side walls of the clips bearing on at least one horizontal surface of the divider below the upper edge of the upstanding wall, the divider extending downward below a bottommost edge of the clips, the rear wall of each clip disposed between the divider and the inner surface of the upstanding wall of the waste container, the side walls of each clip extending away from the rear wall generally toward the other clip, each clip including a leg extending upwardly from the rear wall and over the upper edge of the upstanding wall of the waste container, the leg remaining below a plane defined by an upper edge of the divider, wherein the pair of clips each include a lower wall protruding inwardly from the rear wall and received in one of a pair of notches formed on opposite side edges of the divider to retain the divider in the waste container.

2. The waste container assembly of claim 1 wherein the rear wall of each clip has an inner surface contacting the divider and an opposite outer surface contacting the inner surface of the upstanding wall of the waste container.

3. The waste container assembly of claim 2 further at least one channel integrally formed on the inner surface of the upstanding wall, the divider disposed within the at least one channel.

4. The waste container assembly of claim 3 wherein the at least one channel is adjacent the bottom wall.

5. The waste container assembly of claim 1 wherein the divider includes a pair of opposite side edges abutting the inner surface of the upstanding wall of the waste container, at least one of the side edges including a notch defining an upper side edge spaced away from the inner surface of the upstanding wall and an upper surface, one of the clips engaging the upper surface to retain the divider in the waste container.

6. The waste container assembly of claim 1 wherein the rear walls each include flange portions extending laterally outward from the side walls.

7. A waste container assembly comprising:

a plastic waste container having a bottom wall and integrally-molded opposed first and second side walls attached to the bottom wall and defining an inner compartment therebetween;

a divider received within the inner compartment of the waste container, the divider having a first side edge immediately adjacent the first side wall and an opposite second side edge immediately adjacent the second side wall; and first and second retainers each including a pair of spaced apart side walls extending from a rear wall, the rear wall including flange portions extending laterally outward from the side walls and generally co-planar with the rear wall, the side walls between the flange portions, the divider disposed between the rear walls of the retainers, the rear wall of the first retainer disposed between the divider and the first side wall of the waste container, the rear wall of the second retainer disposed between the divider and the second side wall of the waste container, the spaced apart side walls of each retainer having the divider disposed therebetween, the side walls of the first retainer extending away from the rear wall in a direction generally away from the first side wall, the side walls of the second retainer extending away from the rear wall in a direction generally away from the second side wall, each retainer including a leg extending upwardly from the rear wall and over the upper edge of the upstanding wall of the waste container, wherein the first and second retainers each include a lower wall protruding inwardly from the rear wall and received in one of a pair of notches formed in the first and second side edges of the divider to retain the divider in the waste container.

8. The waste container assembly of claim 7 wherein the rear wall of the first retainer has an inner surface contacting the divider and an opposite outer surface contacting the first side wall of the waste container.

9. The waste container assembly of claim 7 further at least one channel formed integrally on an interior surface of the first side wall, the divider disposed within the at least one channel.

10. The waste container assembly of claim 7 wherein the rear walls of the first and second retainers are not co-planar.

11. The waste container assembly of claim 10 wherein the rear walls of the first and second retainers are not substantially parallel.

12. The waste container assembly of claim 7 wherein the divider includes a pair of opposite side edges abutting the first and second side walls of the waste container, at least one of the side edges including a notch defining an upper side edge spaced inwardly away from the first side wall and an upper surface adjacent the upper side edge, the first retainer engaging the upper surface to retain the divider in the waste container.

13. The waste container assembly of claim 7 wherein the divider includes a tapered lower end.

14. The waste container assembly of claim 7 wherein the waste container includes a handle portion integrally molded with the waste container and projecting outwardly from the first side wall.

15. A waste container assembly comprising:

a waste container having a bottom wall and opposed first and second side walls attached to the bottom wall and defining an inner compartment therebetween, at least one channel formed on an inner surface of at least one of the first and second side walls adjacent the bottom wall;

a divider received within the inner compartment of the waste container and disposed within the at least one channel, the divider having a first side edge immediately adjacent the first side wall and an opposite second side edge immediately adjacent the second side wall; and first and second retainers each including a pair of spaced apart side walls extending from a rear wall, the rear wall including flange portions extending laterally outward from the side walls, the divider disposed between the rear walls of the retainers, the rear wall of the first retainer disposed between the divider and the first side wall of the waste container, the rear wall of the second retainer disposed between the divider and the second side wall of the waste container, the spaced apart side walls of each retainer having the divider disposed therebetween, the side walls of the first retainer extending away from the rear wall in a direction generally away from the first side wall, the side walls of the second retainer extending away from the rear wall in a direction generally away from the second side wall, each retainer including a leg extending upwardly from the rear wall and over the upper edge of the upstanding wall of the waste container, wherein the first and second retainers each include a lower wall protruding inwardly from the rear wall and received in one of a pair of notches formed in the first and second side edges of the divider to retain the divider in the waste container.

16. The waste container assembly of claim 15 wherein the rear wall of the first retainer has an inner surface contacting the divider and an opposite outer surface contacting the first side wall of the waste container.

17. The waste container assembly of claim 15 wherein the rear walls of the first and second retainers are not co-planar and are not substantially parallel.

18. The waste container assembly of claim 15 wherein the divider includes a pair of opposite side edges abutting the first and second side walls of the waste container, at least one of the side edges including a notch defining an upper side edge spaced inwardly away from the first side wall and an upper surface adjacent the upper side edge, the first retainer engaging the upper surface to retain the divider in the waste container.

* * * * *